US009132527B2

(12) United States Patent
Jöst

(10) Patent No.: US 9,132,527 B2
(45) Date of Patent: Sep. 15, 2015

(54) BACKING PLATE UNIT FOR A ROTARY GRINDING MACHINE

(75) Inventor: Peter Jöst, Abtsteinach (DE)

(73) Assignee: JÖST GmbH, Wald-Michelbach (DE)

( * ) Notice: Subject to any disclaimer, the term of this patent is extended or adjusted under 35 U.S.C. 154(b) by 444 days.

(21) Appl. No.: 13/579,889

(22) PCT Filed: Aug. 24, 2011

(86) PCT No.: PCT/EP2011/064526
§ 371 (c)(1),
(2), (4) Date: Aug. 17, 2012

(87) PCT Pub. No.: WO2012/028505
PCT Pub. Date: Mar. 8, 2012

(65) Prior Publication Data

US 2012/0315833 A1 Dec. 13, 2012

(30) Foreign Application Priority Data

Aug. 31, 2010 (EP) ..... 10174588

(51) Int. Cl.

| | |
|---|---|
| ***B24B 55/10*** | (2006.01) |
| ***B24B 41/047*** | (2006.01) |
| ***B24D 9/08*** | (2006.01) |
| ***B24B 9/10*** | (2006.01) |

(52) U.S. Cl.
CPC ..... *B24B 55/102* (2013.01); *B24B 9/10* (2013.01); *B24B 41/047* (2013.01); *B24D 9/08* (2013.01)

(58) Field of Classification Search
CPC .. B23Q 11/0046; B24B 55/10; B24B 55/102; B24B 55/105
USPC ..... 451/451–456
See application file for complete search history.

(56) References Cited

U.S. PATENT DOCUMENTS

| | | | | |
|---|---|---|---|---|
| 1,945,031 | A * | 1/1934 | Decker | 451/359 |
| 2,219,444 | A * | 10/1940 | Eserkaln et al. | 451/456 |
| 3,092,937 | A | 6/1963 | Tocci-Guilbert | |
| 4,549,371 | A * | 10/1985 | Hakoda | 451/456 |
| 4,759,155 | A * | 7/1988 | Shaw | 451/524 |
| 5,218,790 | A * | 6/1993 | Huang | 451/359 |
| 5,392,568 | A * | 2/1995 | Howard et al. | 451/357 |
| 5,609,516 | A * | 3/1997 | Courson et al. | 451/456 |
| 5,807,161 | A * | 9/1998 | Manor et al. | 451/442 |
| 5,810,650 | A * | 9/1998 | Jost | 451/527 |
| 5,993,305 | A * | 11/1999 | Chu | 451/357 |
| 6,361,424 | B1 * | 3/2002 | Manor et al. | 451/490 |
| 6,413,157 | B1 * | 7/2002 | Marton | 451/357 |

(Continued)

FOREIGN PATENT DOCUMENTS

| | | |
|---|---|---|
| BE | 855087 | 9/1977 |
| CA | 1069311 A1 | 1/1980 |

(Continued)

*Primary Examiner* — Lee D Wilson
*Assistant Examiner* — Tyrone V Hall, Jr.
(74) *Attorney, Agent, or Firm* — Hartman Titus PLC; John D. Titus

(57) ABSTRACT

A backing plate unit for a rotary grinding machine includes a backing plate with a front face for mounting a grinding disc and a back face opposite the front face, a drive shaft that can be attached to the tool adaptor of the rotary grinding machine, and a suction hood that is rotatably fixed to the drive shaft. The backing plate 10 includes suction openings that penetrate the backing plate so that the suction hood 30 vacuums dust through the backing plate to the back face of the backing plate.

11 Claims, 12 Drawing Sheets

(56) References Cited

U.S. PATENT DOCUMENTS

Figure 1:
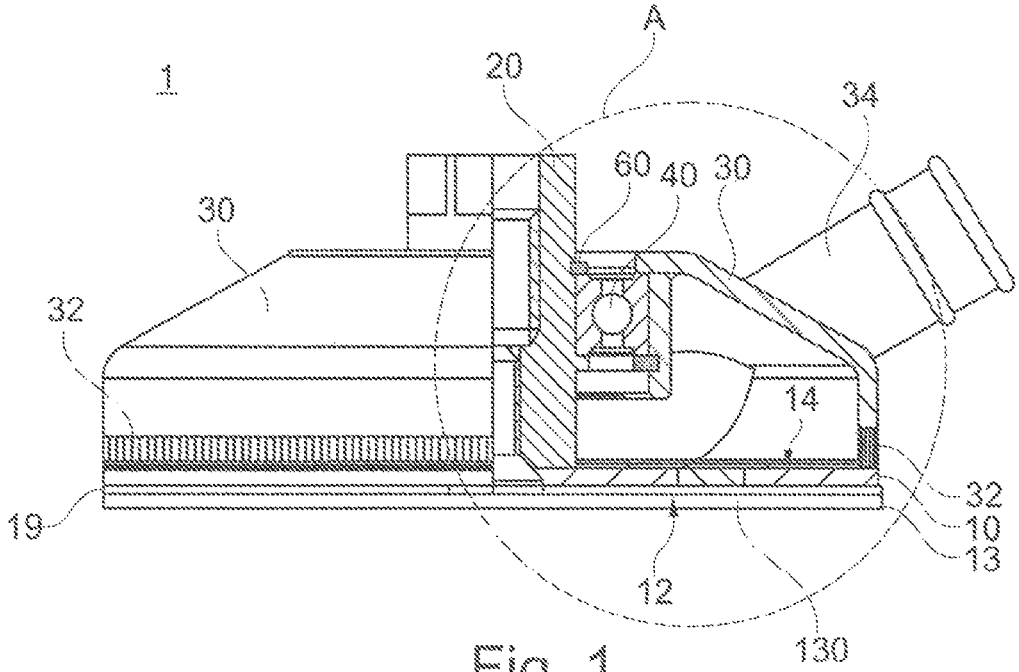

| | | | | |
|---|---|---|---|---|
| 2005/0233681 | A1 | 10/2005 | Jost | |
| 2008/0216272 | A1 | 9/2008 | McLain | |
| 2009/0233527 | A1 * | 9/2009 | Chung-Fat et al. | 451/28 |
| 2010/0144254 | A1 | 6/2010 | Valentini | |

FOREIGN PATENT DOCUMENTS

| | | | | |
|---|---|---|---|---|
| DE | 1085064 | | | 7/1960 |
| EP | 1291134 | A1 | | 3/2003 |
| EP | 1586417 | A2 | * | 10/2005 |
| EP | 2199023 | A2 | * | 6/2010 |
| FR | 2389456 | A | * | 1/1979 |
| FR | 2872076 | | | 12/2005 |
| FR | 2872076 | A1 | * | 12/2005 |
| GB | 1532772 | | | 11/1978 |
| GB | 1532772 | A | * | 11/1978 |
| WO | 2009088772 | A1 | | 7/2009 |
| WO | WO 2009088772 | A2 | * | 7/2009 |
| WO | 2011021087 | | | 2/2011 |

* cited by examiner

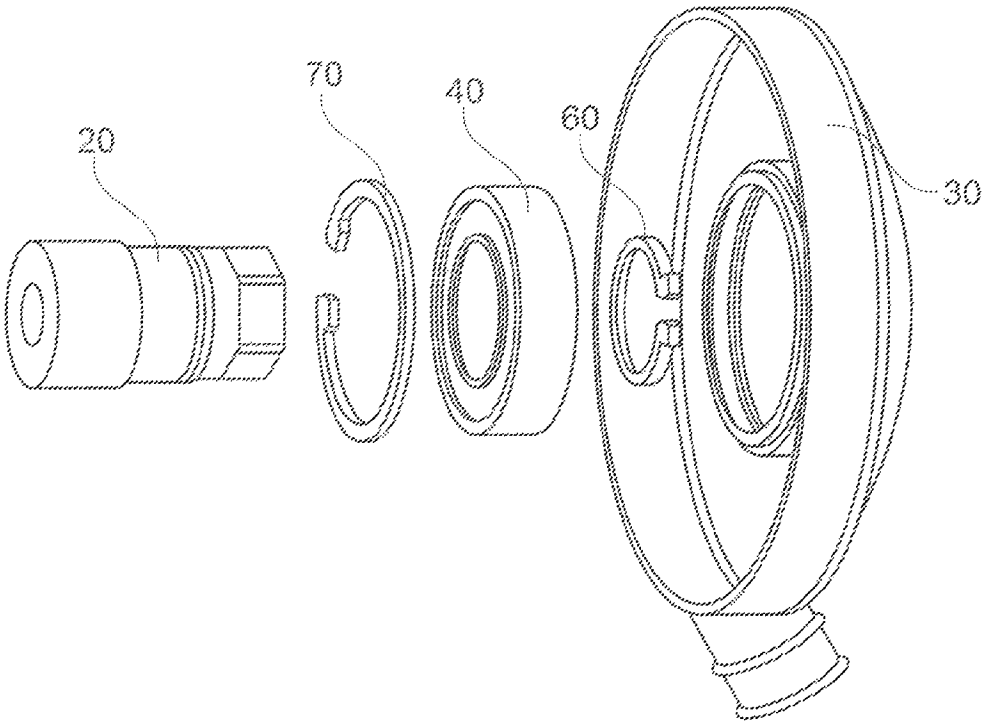
Fig. 5
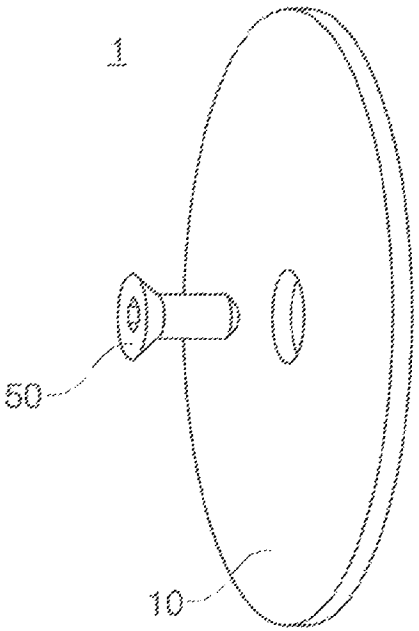

BACKING PLATE UNIT FOR A ROTARY GRINDING MACHINE

1. FIELD OF THE INVENTION

The present invention relates to a backing plate unit for a rotary grinding machine like it is used for the manufacturing of fine surfaces, like for instance in the automotive-, furniture-, painting- and polymer-fields.

2. PRIOR ART

For the manufacturing of super-finished surfaces in general hand grinding machines are used, like for instance eccentric-, delta- and swing-grinders. One of the main reasons therefore is, that these grinding machines are provided with suction devices that allow sucking grinding dust off, that is generated during grinding. That increases the grinding power of the grinding means and results in addition in a better grinding result. But since the oscillating grinding movement, the grinding volumes during grinding with these machines are significantly smaller than with rotatory grinding machines, wherein the grinding means rotates continuously in one direction. For grinding tasks, wherein a higher grinding power is desired and necessary, thus rotary grinding machines, like for instance so called angle grinders, are used.

Fields of use for such rotary grinding machines are for instance the grinding of thick lacquer- or paint-layers on wood or metal. Also the grinding of the very hard anti-fouling-layers of boat hulls is nearly exclusively done by rotary grinding machines. But this is because of the missing suction, neither optimum for the health of the user nor for the environment, since these coatings are declared to be toxic and the grinding dust comes into the environment during grinding. According to this, special environmental requirements have to be fulfilled for such grinding tasks and it has to be kept in mind that no grinding dust comes into surrounding areas and on the floor where it could be flushed during rain into the ground water.

From the document BE 855 087 A1 a device with hollow pins made of hard material is known for the mechanical abrasion of lacquers from surfaces. The hollow pins of the device are mounted elastically and scrape in the meaning of a wire brush lacquer from the surface to be ground.

The document WO 2009/088772 A2 describes adaptors for grinding machines, that are arranged between a backing plate and a grinding disc and which shall ensure the dust transport between every grinding disc and every backing plate.

According to newer developments, suction hoods are offered for such rotary grinding machines like angle grinders that surround the backing plate of the rotary grinding machine usually completely and which shall collect the grinding dust that is centrifuged outward from the grinding disc. Some of these suction hoods are provided at the border with a brush rim for sealing in the direction of the work piece.

But such suction hoods are only machine-specific and are only offered for some few rotary grinding machines. The suction hood is for every machine fixed rigidly to the machine housing and is due to the system significantly larger than the backing plate and the grinding disc so that the grinding result cannot be seen during the grinding process and an accurate grinding is not possible. The suction hood covers the view of the user onto the border of the grinding disc. Such an arrangement with a suction hood that surrounds the backing plate completely is shown in DE 10 2004 018 727 A1.

Some of the formerly known machines try to solve this problem in that the suction hood is open over a specific angle area and allows a view onto the grinding disc. But then in this area no suctioning is carried out anymore so that for such machines inspite of the suctioning very much grinding dust is released.

In addition to that during grinding with a rotary grinder in contrary to the grinding with an eccentric grinder, the grinding disc usually has to be arranged in an acute angle to the work piece. That means that the disc is not always in contact with the work piece with its entire grinding disc surface. According to this, such a suction hood comprises a more or less large distance to the work piece and the brush rim is not able to sufficiently seal at the work piece anymore. Also this leads to a worse suctioning and an increased dust contamination.

Thus it is the problem of the present invention to avoid the above mentioned disadvantages and to provide an optimum suctioning for a rotary grinding machine that in addition allows an accurate working.

3. SUMMARY OF THE INVENTION

The above mentioned problem is solved by a backing plate unit for a rotary grinding machine incorporating features of the present invention.

In particular the above mentioned problem is solved by a backing plate unit for a rotary grinding machine, comprising a backing plate with a front face and a back face oppositely located to the front face and a drive shaft of the backing plate that can be fixed at a tool adaptor of the rotary grinding machine and a suction hood that is rotatably mounted to the drive shaft, wherein the grinding disc comprises suction openings that penetrate the backing plate and the suction hood for a dust suction through the backing plate to the back face of the backing plate.

The backing plate unit according to the invention comprises an integrated suction device in form of a suction hood that is directly rotatably mounted at the drive shaft of the backing plate. The backing plate comprises suction openings that penetrate the backing plate and through which dust can be sucked off via the back face of the backing plate by means of the suction hood. Since the suction hood is rotatably fixed to the drive shaft, an integrated backing plate unit results that can be used independently from the specifically used rotary grinding machine. The connection between the backing plate unit and the rotary grinding machine is realized only by the drive shaft, which is screwed to a tool adaptor of the rotary grinding machine. According to this, a rotary grinding machine without suctioning can be refitted with a backing plate unit with integrated suction elements.

Since the suction hood is arranged at the back face of the backing plate, a dust suctioning can be carried out through the backing plate and via the suction hood. Thus, the dust is sucked off directly at the grinding surface and has not to be centrifuged from the grinding disc outwards in order to be sucked off outside the grinding disc by means of a protruding hood. Thus on the one hand the dust suctioning is improved and on the other hand the life time of the grinding discs is increased since they clog less fast. Furthermore, the advantage results that the border of the grinding disc is always visible and thus an accurate grinding becomes possible.

Preferably, the backing plate unit is designed as a refittable backing plate unit that can be used universally together with any arbitrary rotary grinding machines. Thus any rotary grinding machines can be equipped for dust-free grinding with a backing plate unit according to the invention.

Preferably, the drive shaft is the only necessary connection of the backing plate unit with a rotary grinding machine, so that the backing plate unit is designed as being independent from the machine. The only necessary connection of the backing plate unit to the rotary grinding machine is done at the connection flange of the rotary grinding machine, to which the backing plate unit is screwed instead of the commonly used common backing plates. Further ways of connection between the backing plate unit and the rotary grinding machine are not necessary.

Preferably, the suction hood is not part of the rotary grinding machine and/or the suction hood is not directly connectable to the rotary grinding machine. The suction hood is—contrary to the prior art—an integral part of the backing plate unit and not part of a rotary grinding machine, so that the backing plate unit can be used independently from the machine. In particular, the rotary grinding machine can be equipped with backing plate units of different sizes, for which an optimum suction of the grinding dust is ensured.

Preferably the suction hood is fixed via a rotary bearing, in particular a ball bearing, at the drive shaft. By doing so, the suction hood does not need any further fixation, in particular not at the rotary grinding machine. Preferably, a sealed ball bearing is used for the fixation of the suction hood to the drive shaft.

In a further preferred embodiment the suction hood is designed in that the outer border of the backing plate stays visible during operation. Thus an accurate grinding and an optimum control of the grinding result is ensured. The suction hood also does not hinder the user during grinding up to edges etc. Preferably, the outside diameter of the barrel of the suction hood corresponds essentially with the diameter of the backing plate. Thus, an optimum suction through the backing plate is ensured wherein in addition an optimum view on the edge of the grinding disc is ensured.

Preferably, the suction hood comprises at its border facing the backing plate a brush rim or a slip ring. The brush rim or the slip ring allows a rotation of the backing plate with respect to a still-standing suction hood and ensures simultaneously a good sealing between these two parts in order to use the generated low pressure in the suction hood possibly completely for the dust suctioning through the grinding disc.

Preferably, the suction hood comprises a suction socket for a pipe of a dust suction device. An industrial vacuum cleaner is commonly connected to the suction socket of the suction hood, which sucks the dust off that is generated during grinding and collects it. Simultaneously, the pipe impedes, that the suction hood rotates by the remaining friction in the rotary bearing together with the backing plate.

Preferably, the drive shaft comprises a rubber member. This rubber member compensates a canting of the backing plate and ensures that the backing plate always lies even on the work piece if desired and thus no grooves are affected.

Preferably, the suction hood comprises bellows at its barrel. The bellows compensate slight differences in the angle between suction hood and the backing plate and ensure a good sealing of these parts.

Preferably, the backing plate comprises at its front face a hook-and-loop-layer for the fixation of grinding discs that are able to be fixated by hook-and-loop-connection by means of the hook-and-loop-layer. A simple and mechanically safe fixation is carried out by for grinding discs that can be attached by hook-and-loop-connection and furthermore perforated grinding discs can be used, wherein the dust transport takes place at the back side of the grinding disc through the hook-and-loop-layers. In this case the suction openings in the backing plate can be arranged at positions that are optimal in view of the technical process and do not have to correspond with possible openings in the grinding discs.

Preferably suction openings are arranged at least in the area of the outer border of the backing plate. By means of the high rotational speed of the backing plate during grinding, the dust is centrifuged outwards by the centrifugal force—in particular during a dust transport in the hook-and-loop-layer—and the dust is then sucked off at the outer region of the backing plate through the suction openings that are arranged there at the border of the backing plate. Thus it is ensured, that also grinding dust that is generated at the border of the backing plate is not centrifuged outwards but is safely sucked off.

In a preferred embodiment the suction openings are arranged at the border of the grinding disc in that at the entire circumference of the backing plate as seen in radial direction comprises always suction openings. Thus it is ensured that dust that moves due to the centrifugal force in radial direction from the middle of the backing plate outwards to the border always meets a suction opening at the border of the backing plate and is sucked off there through. As seen in radial direction there are no gaps between suction openings through which dust could be centrifuged outwards without being sucked off.

The above mentioned problems are also solved by a backing plate for a rotary grinding machine comprising a hook-and-loop-layer for the fixation of grinding discs having a hook-and-loop-connection and suction openings that penetrate the backing plate, wherein the sucking openings are arranged at the border of the backing plate in that at the entire circumference as seen in radial direction of the backing plate always suction openings are present. Dust that is generated during grinding that enters the backing plate through openings, in particular perforation openings, into the hook-and-loop-layer behind the grinding surface and moves then radially by the centrifugal forces outwards meets on this way at the border of the backing plate always a suction opening through which the dust is sucked off backwards through the backing plate. According to this, no dust can be centrifuged from the backing plate outwards anymore and contaminates the environment.

Preferably, the suction openings are realized as curved, mutually overlapping slots. It has been proved that relatively narrow, curved, mutually overlapping slots at the border of the backing plates ensure an optimum suction of the grinding dust in particular for perforated grinding discs.

In a further preferred embodiment, the border of the backing plate is rounded at the front face. By doing so the grinding disc that is attached onto the backing plate effects during grinding at the border a lower pressure than more inside. This is insofar advantageous, that then the border of the grinding disc does not leave any grinding tracks, what results overall in particular in a better grinding result, in particular during fine- and polishing-grinding. Furthermore, it is also possible to grind with a rounded border of the backing plate also upstands with a rounded fillet. Therefore, in particular the backing plate unit according to the invention can be used since it does—contrary to an eccentric grinder—not use an eccentric stroke but a pure rotational movement. Thus, it is possible to grind inside edges with the border of the backing plate.

Preferably, the border of the backing plate is broadened to become a barrel face. Also this allows a qualitatively optimum and fast grinding of an edge or concave fillet of a work piece, wherein an exact radius of the concave fillet can be realized. This is likewise not possible with eccentric grinders.

In a further preferred embodiment, the barrel face of the backing plate is penetrated by suction openings. Therewith also the dust that is generated during the grinding at the barrel face of the backing plate can be sucked off through the backing plate.

A further aspect of the present invention relates to the use of the backing plate unit of a backing plate according to one of the aforementioned claims with perforated grinding discs that can be fixed by hook-and-loop-connection. The above mentioned advantages of the backing plate unit according to the invention or the backing plate according to the invention are in particular provided during the use in combination with perforated grinding discs that can be fixed by hook-and-loop-connection, wherein dust that is generated during grinding is conducted on the shortest possible way through perforation openings in the grinding disc from the grinding surface backwards into the hook-and-loop-layers and is sucked off there through the suction openings in the backing plate and then through the backing plate. Thus, perforated grinding discs can be advantageously used now also in combination with rotary grinding machines, which comprise a significantly higher grinding power compared with oscillating grinding machines.

Further preferred embodiments of the invention are described in the dependent claims.

4. SHORT DESCRIPTION OF THE DRAWING

Figure 2:
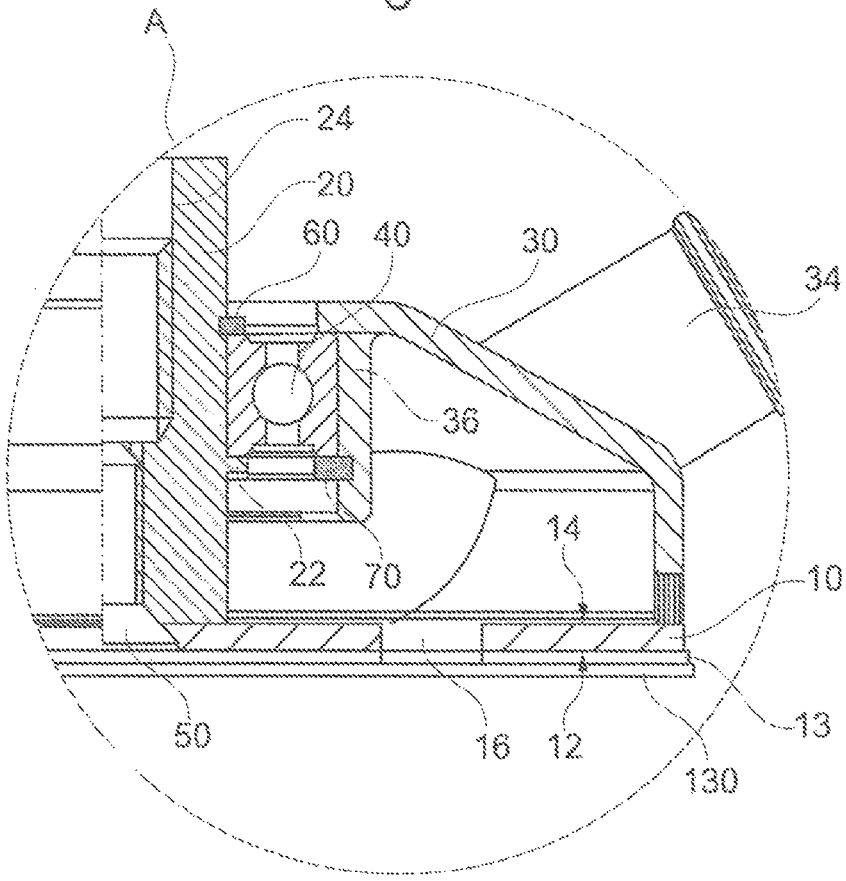
Figure 3:
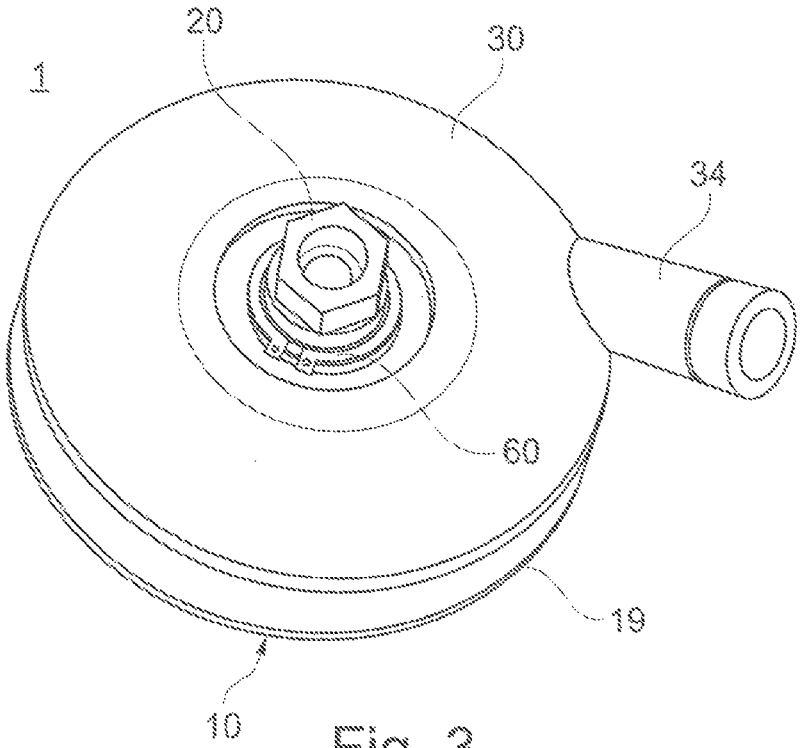
Figure 4:
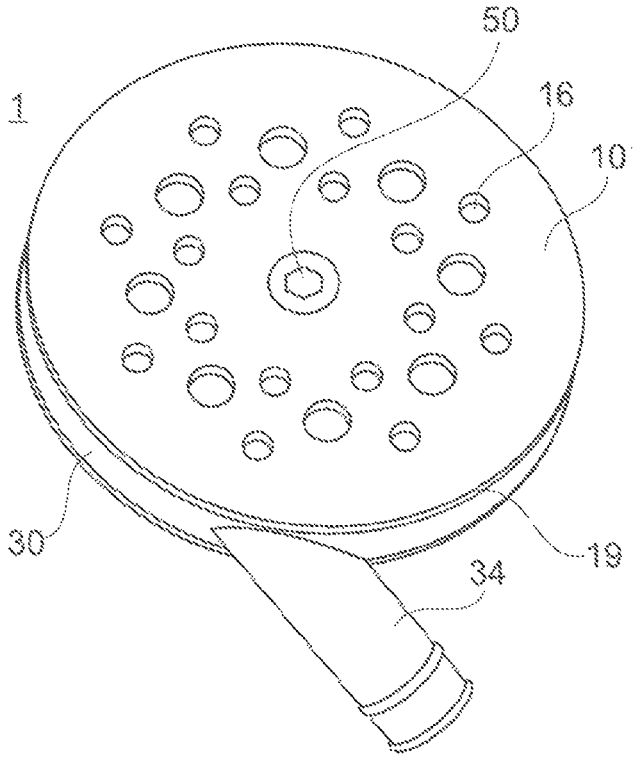
Figure 6:
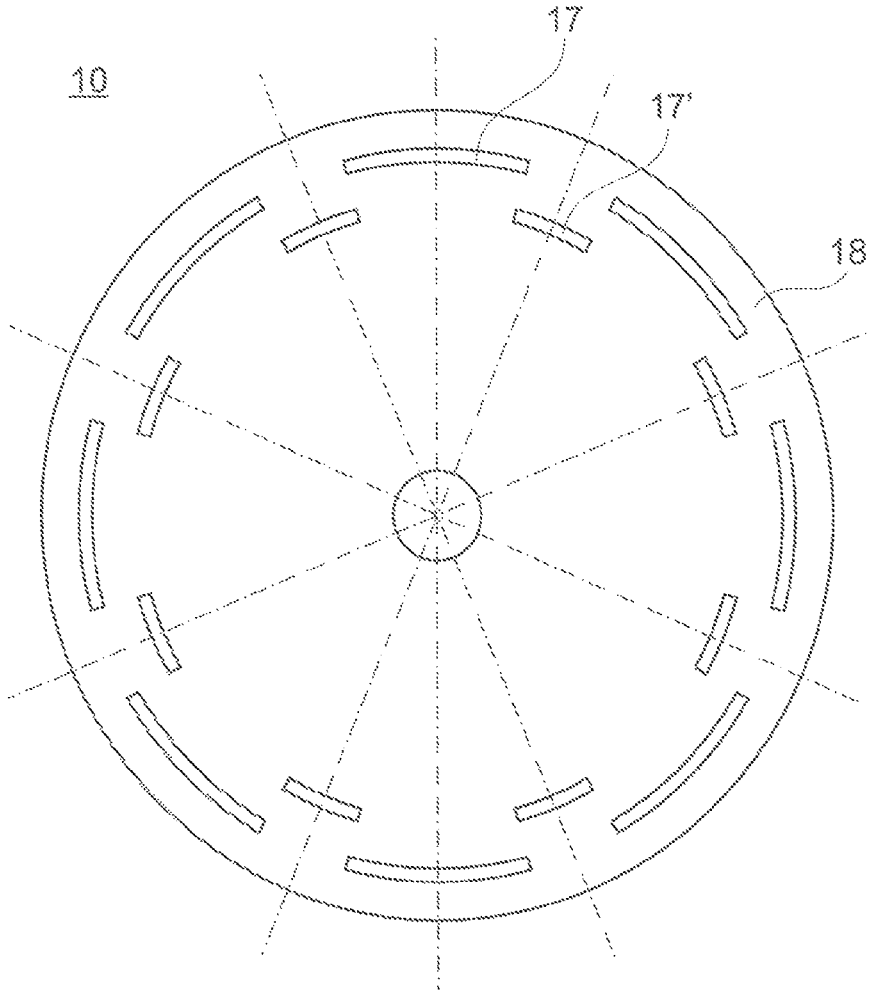
Figure 7A:
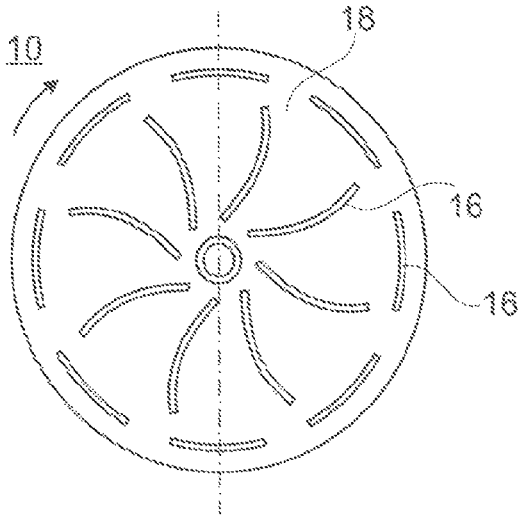
Figure 7B:
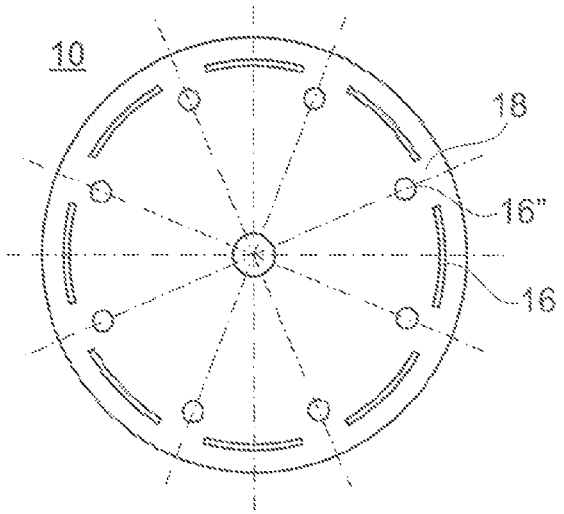
Figure 7C:
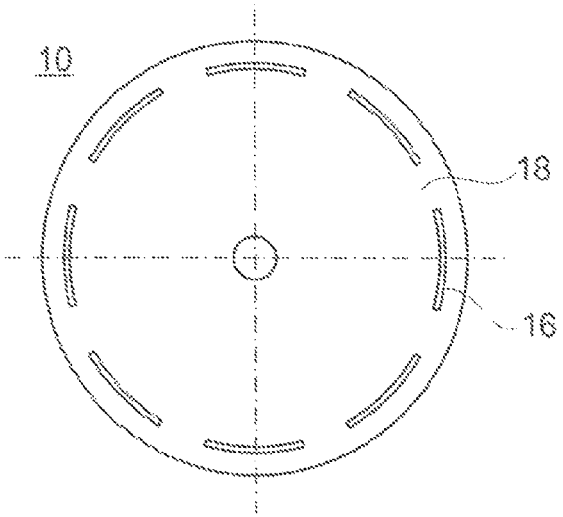
Figure 8:
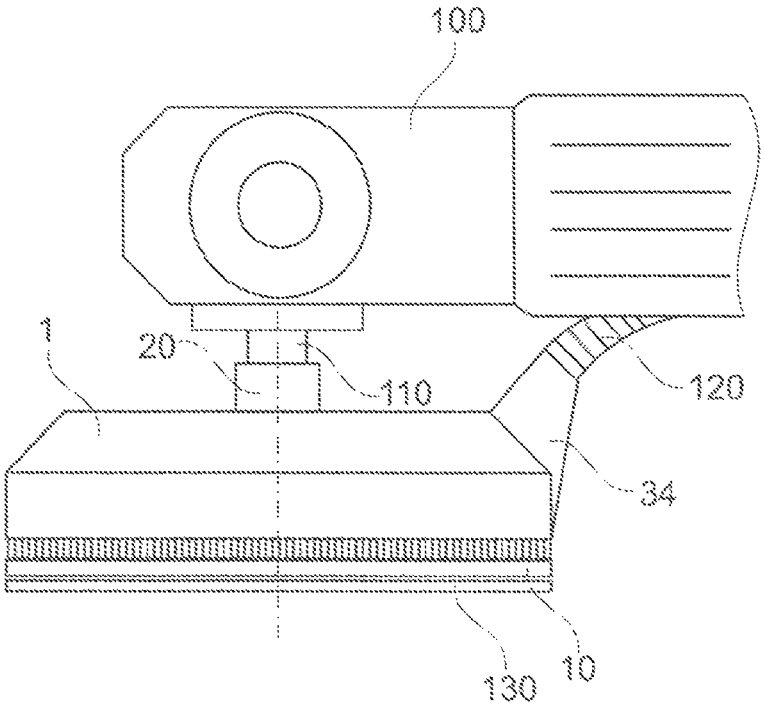
Figure 9:
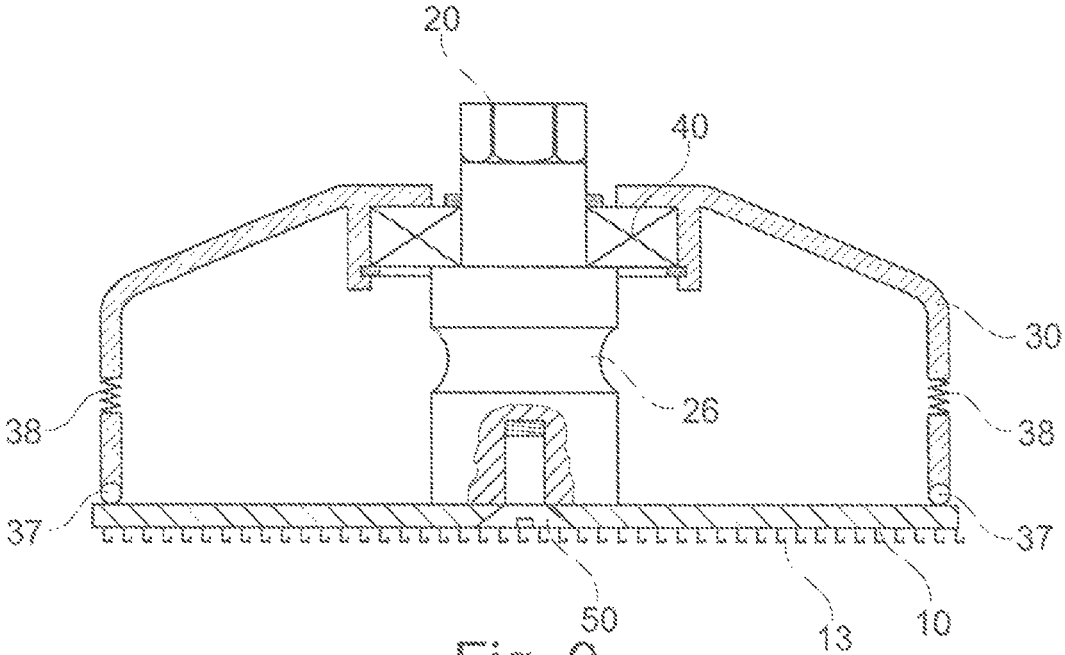
Figure 11:
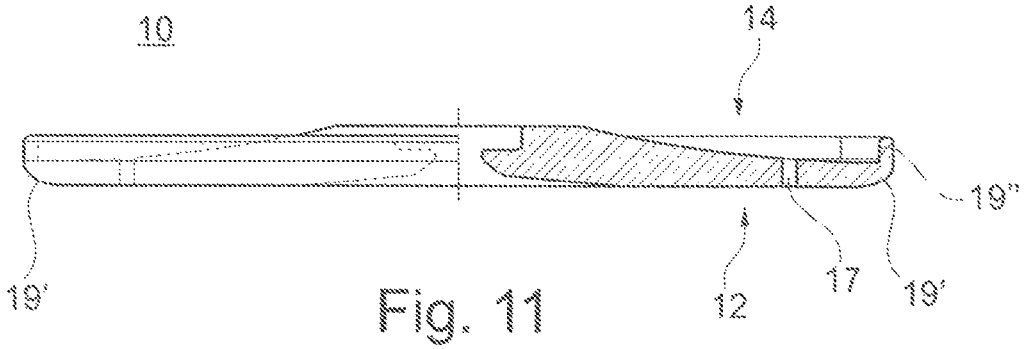
Figure 12:
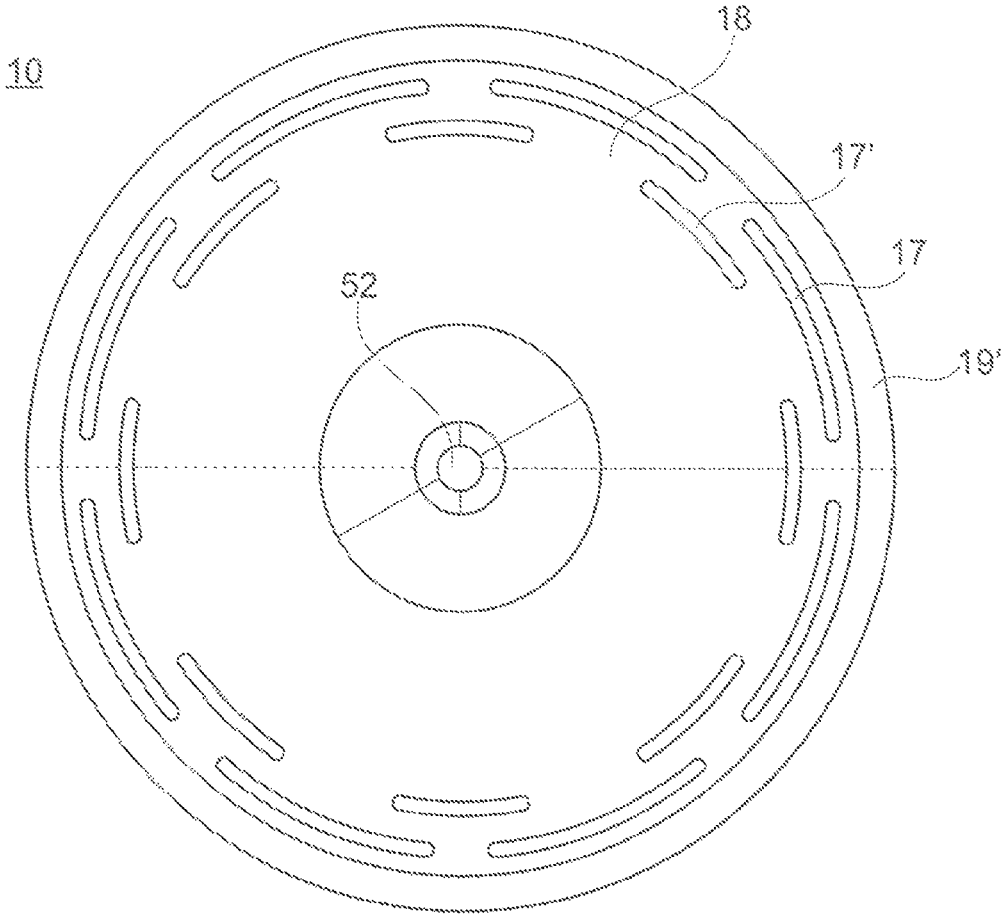
Figure 13:
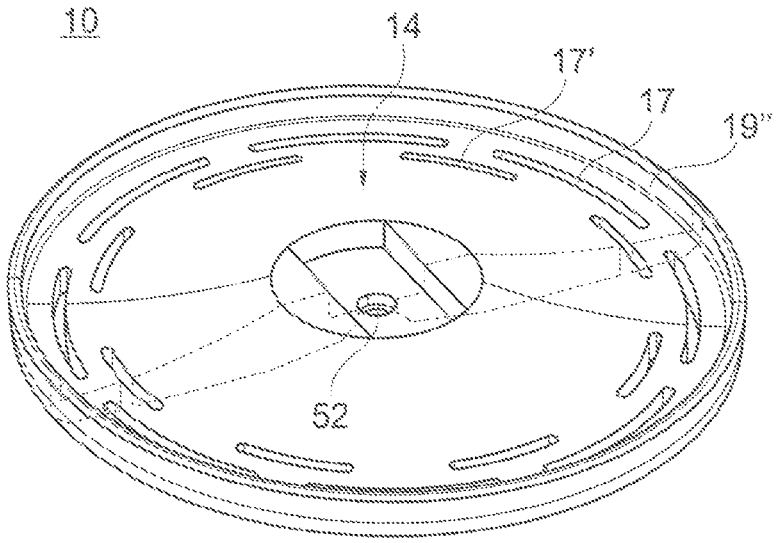
Figure 14:
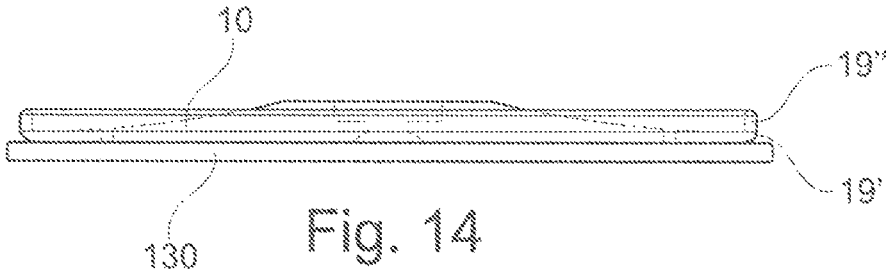
Figure 15:
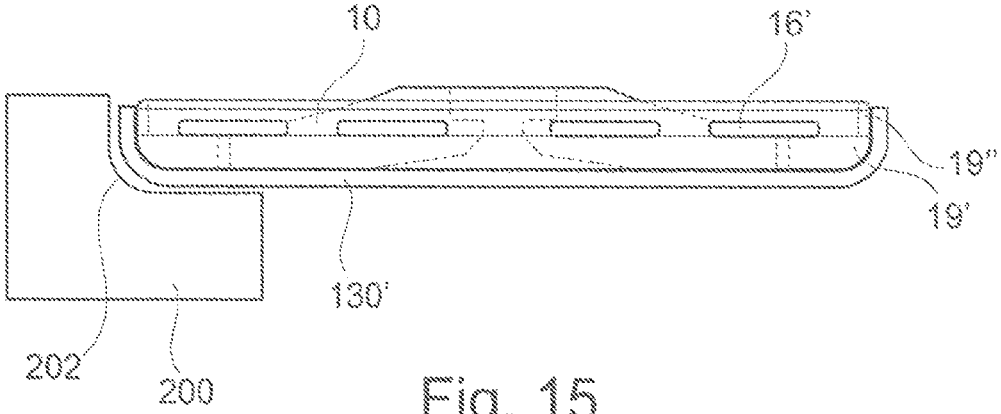
Figure 16:
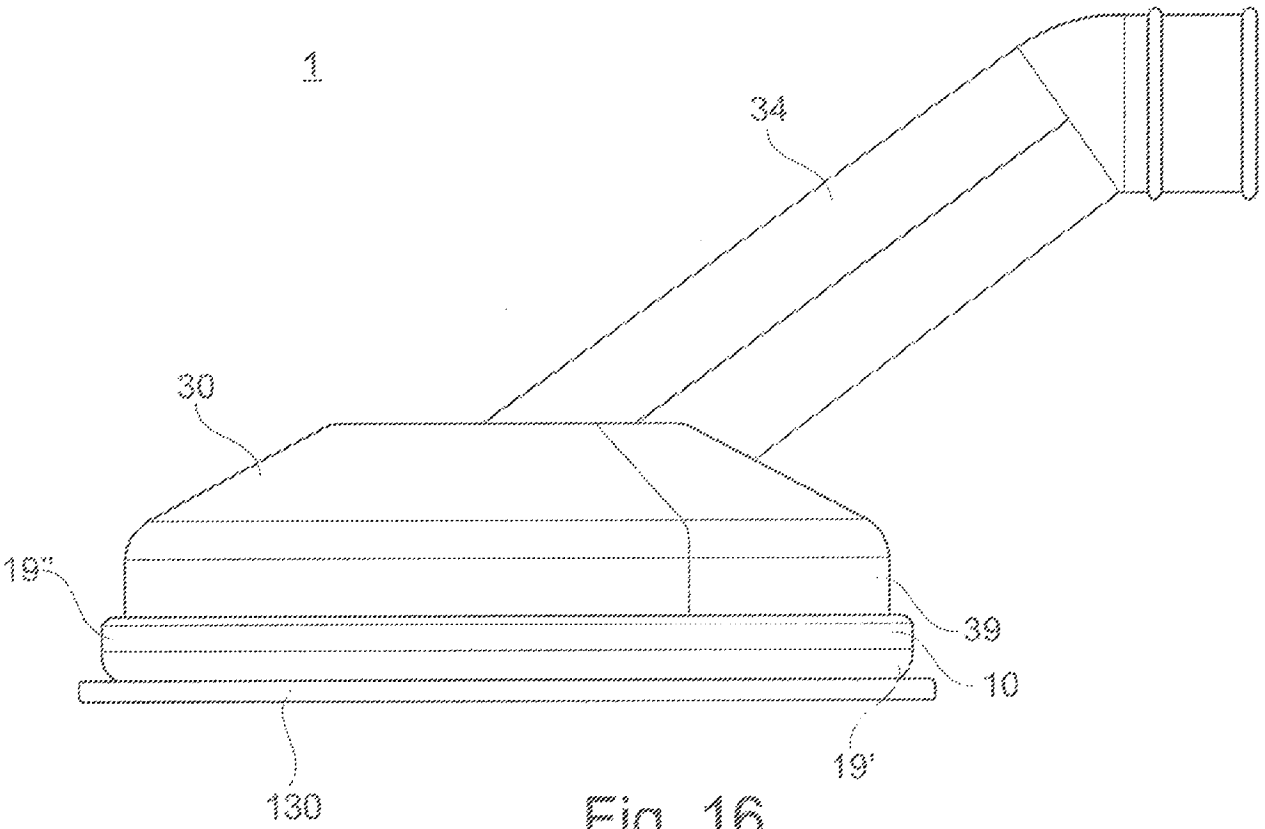

In the following preferred embodiments of the invention are described by the use of the accompanying drawing in which shows:

FIG. 1 A partially cross-sectional side view of an embodiment of a backing plate unit according to the invention;

FIG. 2 A detailed view A of the backing plate unit according to FIG. 1;

FIG. 3 A three dimensional view of an embodiment of a backing plate unit according to the invention with a view onto the suction hood and the drive shaft;

FIG. 4 The backing plate unit according to FIG. 3 with a view on the backing plate;

FIG. 5 An exploded view of the parts of the backing plate unit according to FIG. 1;

FIG. 6 An embodiment of a backing plate according to the invention with suction openings at the border of the backing plate;

FIG. 7A-C Embodiments of backing plates according to the invention with different suction openings;

FIG. 8 A schematic view of a backing plate unit that is fixed at an angle grinder;

FIG. 9 A partially cross-sectional side view of a further embodiment of the backing plate unit according to the invention;

FIG. 10A-E Embodiments of perforated grinding discs;

FIG. 11 A partial cross-section of a further embodiment of a backing plate according to the invention with a rounded backing plate border;

FIG. 12 A view from below on a backing plate according to FIG. 11;

FIG. 13 A three dimensional view of a grinding disc according to FIG. 11;

FIG. 14 A side view of a grinding disc according to FIG. 11 with a plain grinding disc;

FIG. 15 A side view of a further embodiment of a backing plate according to the invention with a rounded backing plate border with a grinding disc during processing of an upstand;

FIG. 16 A three dimensional view of a further embodiment of a backing plate unit according to the invention.

5. DESCRIPTION OF THE PREFERRED EMBODIMENTS

In the following, preferred embodiments of the present invention are described by means of the accompanying figures. Features of single embodiments can be also combined with other embodiments.

FIGS. 1 to 5 show a first preferred embodiment of a backing plate unit 1 for a rotary grinding machine 100. As shown in FIG. 1 in a partial section view and FIG. 2 in detail, the backing plate unit 1 comprises a drive shaft 20, at which by means of a screw 50 a backing plate 10 is rigidly connected. A suction hood 30 is rotatably mounted at the drive shaft 20 via a ball bearing 40. Thus, it is possible to suck off dust by means of the suction hood 30 through the backing plate 10 by means of a suction pipe 120 that is connected to a suction socket 34.

As it can be seen in particular in FIG. 2, the suction hood 30 is only rotatably fixed to the drive shaft 20. To this end, a ball bearing 40 is inserted in a cylindrical seat 36 of the suction hood 30 wherein the ball bearing 40 is locked in the seat 36 by means of a shaft locking ring 70. The bearing 40 is adapted in view of the drive shaft 20 to the outer diameter of the shaft 20 and abuts a stop ring 22. Upwards, the bearing 40 is held at the drive shaft 20 by means of a further shaft locking ring 60, that engages in a slot at the outside the drive shaft 20. Preferably, a sealed ball bearing is used for the ball bearing 40 in order to maintain a possibly high vacuum inside the suction hood 30.

The drive shaft 20 comprises at its upper end a boring 24 with an internal thread that can be attached to a tool adaptor 110 of a rotary grinding machine 100 by screwing. In this way, the backing plate unit 1 can be connected to a rotary grinding machine 100 that does not need specific design features for a suction device. Thus, the backing plate unit 1 is appropriate for refitting of common rotary grinding machine 100 without suction devices so that a dust free grinding can be carried out also with these machines. The only necessary connection of the backing plate unit 1 with the rotary grinding machine 100 is realized by the drive shaft 20, so that the backing plate unit 1 can be used independently from the machine with any arbitrary rotary grinder 100. In FIG. 8, the connection of the backing plate unit 1 at a rotary grinder 100 (here an angle grinder) via the drive shaft 20 that is screwed to a tool adaptor 110 is shown symbolically. In addition to this connection, at a rotary grinder 100 the backing plate unit 1 is connected via the suction socket 34 with a suction pipe 120 that is connected to a common industrial vacuum cleaner (not shown). The connection of the backing plate unit 1 at the suction pipe 120 prevents a rotation of the suction hood 30 during grinding operation. Since the suction hood is supported preferably rotatably by a ball bearing 40 at the drive shaft 20 therefore only small holding forces are needed that can be applied by the suction pipe 120 easily. The suctioning by an industrial vacuum cleaner and by the suction pipe 120 is carried out independently and in addition to the driving by a rotary grinder 100.

The present invention is not limited to handheld rotary grinders like the angle grinder of FIG. 8. The backing plate unit 1 can be also used for industrial grinding machines or grinding systems, wherein rotating backing plates are used for mass processing of work pieces. Also here the advantages according to the invention of a reduced dust contamination of the environment, significantly higher lifetimes of the grinding discs and a better surface quality result are realized.

In order to ensure a best possible suction, a brush rim 32 is fixed at the suction hood 30 between the still-standing suction hood 30 and the backing plate 10, which rotates during use, wherein the suction hood 30 seals the necessary gap between suction hood 30 and backing plate 10.

FIG. 2 shows that the outer diameter D of the barrel 39 of the suction hood 30 corresponds essentially to the outer diameter of the backing plate 10. Thus, the user has always optimal view on the edge of the backing plate 10 during grinding. Thus by the backing plate unit 1 an edge-precise fine grinding of work pieces is possible. Simultaneously high grinding powers are possible with the rotating backing plate 10 contrary to oscillating tools.

The backing plate 10 preferably consists of a thin plate, for instance an aluminum plate with a thickness of 2-4 mm, in which suction openings 16 are inserted. During operation the grinding dust that is generated at the grinding surface passes through the suction openings 16 in the backing plate 10 and is sucked off by the vacuum inside the suction hood 30 via the suction socket 34 by the suction devices (pipe 120 and industrial vacuum cleaner).

As shown in FIG. 2, the backing plate 10 comprises at its front face 12 a hook-and-loop-layer 13 that is preferably adhered to the backing plate 10. Grinding discs 130 that can be fixed by hook-and-loop-connection can be fixed at this hook-and-loop-layer 13 that is for example a hook-layer or a mushroom-layer. Such grinding discs that can be fixed by hook-and-loop-connection consist of a paper-, tissue- or sheet-carrier on which at the back face a hook-and-loop-fixation-layer, in particular a hook-and-loop-fleece-layer or a hook-and-loop-velour-layer is adhered. At the front face, the grinding disc 130 is provided with abrasive grinding particles that are fixed to the underground by a suitable embedding material.

For dust suctioning such grinding discs 130 that can be fixed by hook-and-loop-connection are provided with openings, through which the grinding dust that is generated at the grinding surface can be sucked off. Generally, there are two different types of grinding discs for suction devices, namely grinding discs with few relatively large suction openings that are brought in line with the corresponding suction openings in the backing plate 10. But such grinding discs have the disadvantage that the way of the grinding particle at the grinding surface to the corresponding suction opening is relatively long and that thus such grinding discs clog relatively fast and become unusable.

Figure 10A:
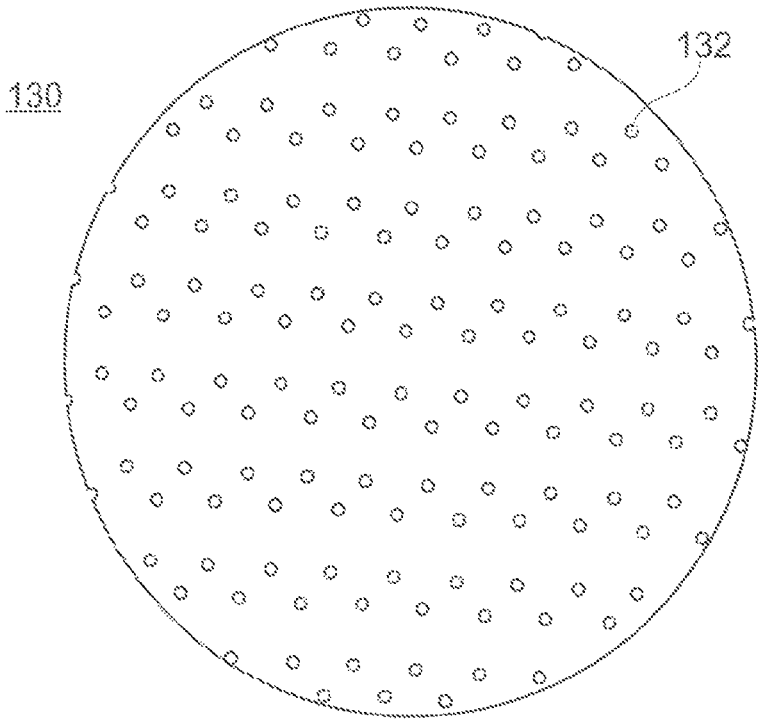

Besides of this, there are so called perforated grinding discs 130 that comprise a perforation of small perforation openings 132 that are essentially distributed over the entire surface of the grinding disc 130. Exemplary grinding discs 130 with such perforation openings 132 that are in general spread over the entire surface of the grinding disc 130 are shown in the FIGS. 10A-10E. The embodiments that are shown there show grinding discs 130 with a diameter of about 115 mm, wherein the perforation openings 132 of the grinding discs 130 of the FIGS. 10A-C comprise a diameter of 1-2 mm, of the grinding discs of FIG. 10D a diameter of 2-4 mm and of the grinding discs of FIG. 10E a diameter of 4-6 mm. The distance of the perforation openings according to FIG. 10 B is about 5 mm, the distance of the perforation openings of FIGS. 10A, 10C and 10D is minimum 6 mm and maximum 10 mm, for the grinding discs of FIG. 10 the distance is minimum 10 mm and maximum 30 mm. The pattern of the perforation openings 132, its size as well as its distance to each other is determined in view of the specific desired grinding task. Such grinding discs 130 are common in sizes of preferably 50, 115, 150, 200 mm to 500 mm in diameter.

Such perforated grinding discs 130 ensure a dust transport over the entire surface of the grinding disc 130. The grinding dust is sucked off by the present vacuum through each perforation opening 132, passes through the underground and into the hook-and-loop-layer. There, the dust flows inside the hook-and-loop-layer to the suction openings 16 in the backing plate 10, through which it is sucked off. Thus, the dust transport is realized at the back face of the backing plate inside the hook-and-loop-adaption-layer and inside the hook-layer. For such grinding discs 130 it is not necessary to provide an exactly corresponding hole pattern in the backing plate 10. All in all the life time and the grinding result of such perforated grinding discs 130 is n-fold higher than for common grinding discs with some large suction holes. As it can be seen from the patterns of the perforated openings 132 of the FIGS. 10A-10E even such grinding discs 130 are appropriate for the above described dust removal over the entire surface, wherein partial regions, like for instance the border like in FIG. 10 D are not perforated. Thus also this grinding disc 130 comprises perforation openings 132 that are distributed essentially over the entire surface of the grinding disc 130. In order to allow in the present case for the rotary grinder 100 an optimum suction of the dust, a backing plate 10 with a specific arrangement of suction openings 16, 17 is proposed for perforated grinding discs 130. Due to the high rotational speed of the backing plate 10 during operation the dust is transported radially outwards due to the centrifugal force. In order to ensure a best possible dust-free grinding, the suction openings 16, 17 should be arranged near the border 18 of the backing plate 10, so that dust that is generated there can be sucked off safely contrary to the centrifugal force. Dust that is generated in the inner area of the grinding disc 130 moves imperatively outwards in the direction of the border 18 and is then sucked off there also. Preferred patterns for suction openings 16, 17 are shown in the FIGS. 6 and 7A-7C.

A pattern according to FIG. 6 is in particular preferred. In this embodiment, the suction openings 17, 17' are arranged at the border 18 of the backing plate 10 in that in radial projection (that means as seen radially from inside outwards) a suction opening 17, 17' is always present at the entire circumference of the backing plate 10 so that no gaps exist between them. In the embodiment of FIG. 6, the suction opening 17, 17' are formed as curved, mutually overlapping slots 17 that are arranged in two concentric circles. In the shown embodiment for a backing plate 10 with a diameter of for example 115 mm the slots are about 1-2 mm wide and comprise a length at the outer ring of about 30 mm and at the inner ring of about 15 mm. The slots 17' of the inner ring are arranged in front of the necessary gaps between the slots 17 of the outer ring.

Of course, the shape and the arrangement of the mutually overlapping suction openings 16, 17 can be varied depending on the size of the backing plate or the embodiment. But it is important that there are—as seen from inside outwards—at the border no gaps between the suction openings through which the dust could be released. At least the gaps should not be so large that the centrifugal forces that effect on the dust are higher than the forces of the suction effect. The dust that is generated during grinding passes due to the suction effect through the perforation openings 132 through the underground of the grinding disc 130 and into the hook-and-loop-layers behind the grinding surface is then moved radially outwards through the suction air and the centrifugal forces and then through one of the suction openings 16, 17 that are located at least at the border 18 of the backing plate 10 into the suction hood 30. From there, the dust is sucked off through the suction socket 34 and the suction pipe 120 into a suction device (for instance a vacuum cleaner). Thus, a nearly dust-free grinding is possible with the backing plate unit 1.

Further designs for preferred suction openings are shown in the FIGS. 7A, 7B and 7C. In the embodiment of FIG. 7A there are in addition to curved slots 16 at the border 18 of the backing plate also curved slots 16' in the inner area of the backing plate, what shortens for large backing plate diameters like for instance for diameters of 150 mm, 200 mm or larger the way that has to be gone by the dust in the hook-and-loop-layers. Thus less jammings of dust appear there.

In FIG. 7B in addition to curved narrow slots 16 at the border 18 of the backing plate 10 suction openings 16" are arranged in front of the gaps between the slots 16 that hinder a passing of dust through the gaps between the slots 16.

FIG. 7C shows a simple form of a backing plate 10 with curved suction slots 16 that are arranged at the border 18, wherein the distance between the slots is chosen in that the suction effect is sufficient in order to suck off the dust that wants to pass between the slots outwards.

FIG. 4 shows another hole pattern for suction openings 16 at the backing plate 10, which are for instance appropriate for grinding discs of the type with few larger holes. The backing plate 10 of FIG. 5 is also provided with suction openings 16, 17, for instance those of FIGS. 6 and 7A to C, wherein they are not shown in FIG. 5.

FIG. 9 shows another further preferred embodiment of a backing plate unit 1. This backing plate unit 1 differs from the backing plate unit 1 of the FIGS. 1-5 in that the drive shaft 20 comprises a rubber member 26, so that the backing plate 10 with the grinding disc 130 always stays plane on the surface to be ground during fine-grinding. This prevents a canting of the grinding disc 130 and provides a groove-free grinding result. In order to compensate the angle between the backing plate 10 and the suction hood 30 and for an optimum sealing at the transition between both elements the barrel of the suction hood is equipped with bellows 38.

A slip ring 37, preferably made of a polymer material like for instance Teflon, reduces the friction between the backing plate 10 and the suction hood 30 that also preferably consists of a polymer material. The bellows 38 press the slip ring 37 against the backing plate 10.

Figure 10B:
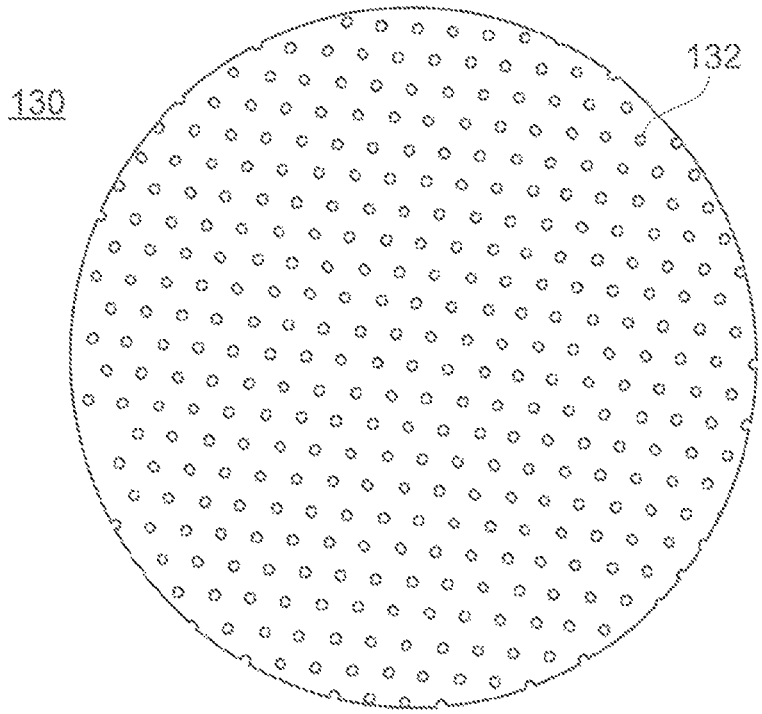
Figure 10C:
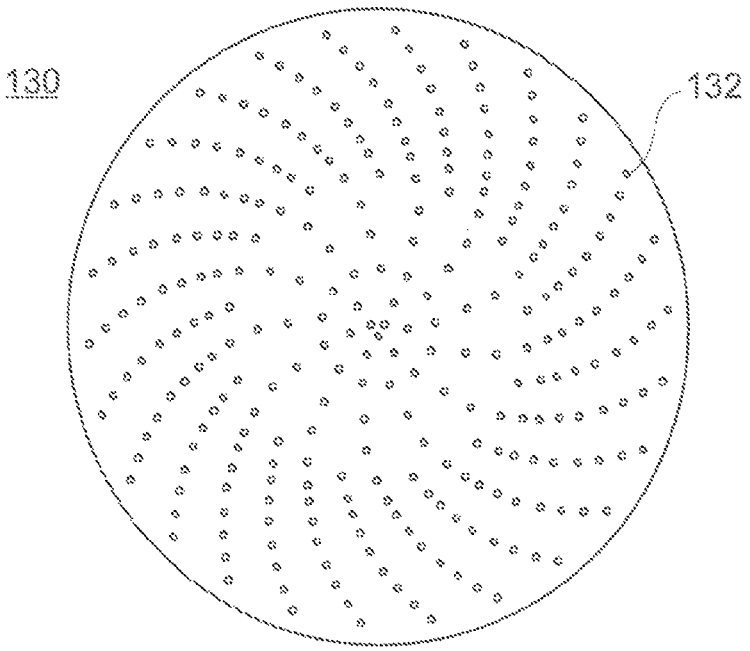
Figure 10D:
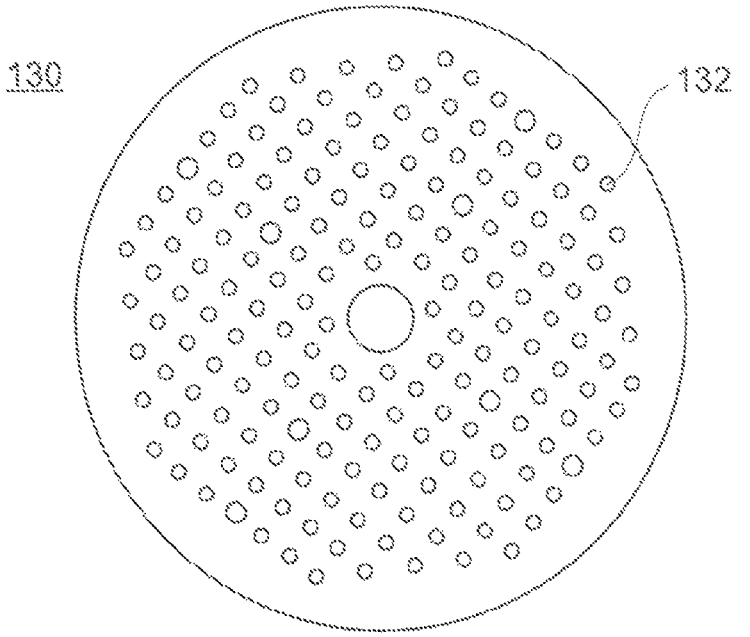
Figure 10E:
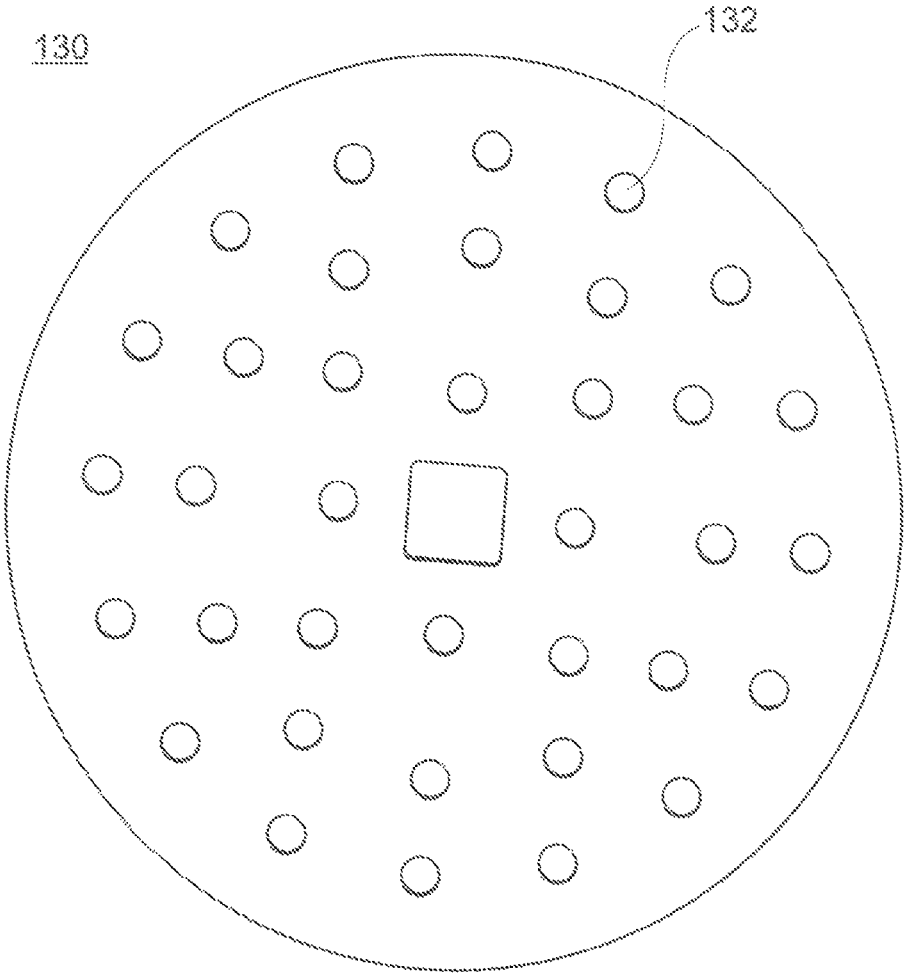

The grinding disc 130 of FIGS. 10A and 10B show two examples of perforated grinding discs that may differ in varying sizes, particle sizes, perforation opening sizes, number of perforation openings, distance of perforation openings, arrangement of the perforation openings etc. But it is important for this kind of perforated grinding discs 130 that the perforation expands essentially over the entire surface of the grinding disc 130 in order to ensure a dust removal over the entire grinding surface.

FIGS. 11-15 show a further preferred embodiment of a backing plate 10 according to the invention that can be used in combination with the backing plate unit 1 of the other embodiments. Contrary to the backing plate 10 of FIGS. 1-9, the backing plate 10 of FIGS. 11-13 comprise a border area 19' that is rounded at the front face 12 of the grinding disc 10. Thus the border area 19' effects on a grinding disc 130 that is fixed to the backing plate 10 a lower pressure than in inner areas of the front face 12 of the backing plate 10. That prevents grinding groves during fine grinding.

The border 19 of the backing plate 10 can be in addition elevated as shown in the FIGS. 11-15, in order to be widened to become a barrel surface 19". Herewith, the backing plate 10 and the backing plate unit 1 can be used for instance for grinding of upstands and concave fillets 202 of a work piece 200. Therefore, grinding discs 130' that are adapted in the border area and also elevated like they are shown in FIG. 15 exemplarily. These grinding discs 130' comprise also perforation openings 132 like they are shown in the FIGS. 10A and 10B exemplarily. Grinding discs 130' that also may consist of flexible material, bend themselves during grinding of upstands 202 upwards and adapt themselves to the rounded border 19' and the barrel surface 19".

Same like the backing plate 10 of FIGS. 1-9 the backing plates 10 of FIGS. 11-15 comprise at least in the border area 18 suction openings 17, 17' that are used for dust suctioning from the grinding disc 130 in particular out of its hook-and-loop-layer. As shown, suction openings 17, 17' are arranged in that in radial direction as seen from inside outwards suction openings 17, 17' are present at the entire circumference of the backing plate 10, so that the dust that is centrifuged by the centrifugal force outwards is transported at a border 18 through the backing plate 10 backwards. As shown in FIG. 15, the barrel surface 19" can be penetrated by suction openings 16' in order to ensure a dust suction also at the barrel surface 19".

The backing plate 10 further comprises an opening 52 for the fixation with a screw 50 to the drive shaft 20.

FIG. 16 shows a further preferred embodiment of a backing plate unit 1 that comprises a backing plate 10 of FIGS. 11-15 with a rounded border 19' that is broadened upwards to become a barrel surface 19". By means of its upwards extending barrel surface 19" the barrel 39 of the suction hood 30 can engage from above with the backing plate 10 and thus seals it with respect to the backing plate 10. Also in this embodiment the diameter of the barrel 39 of the suction hood 30 is essentially the diameter of the backing plate 10 so that dust can be sucked off in particular at the border area 18 through the backing plate 10. The diameter of the backing plate 10 is slightly enlarged in view of the diameter of the barrel 39 of the suction hood, such that a processing of upstands and concave fillets 202 is possible without any problems.

In comparison with the embodiment of FIGS. 1-5 the suction socket 34 is elongated in the embodiment of FIG. 16 that allows on the one hand a better leverage effect for the fixation of the suction hood 30 and on the other hand another guidance of the suction tube (not shown) that is connected to the suction socket 34.

LIST OF REFERENCE NUMBERS

1 Backing plate unit
10 Backing plate
12 Front face
13 Hook-and-loop-layer
14 Back face
16, 16' Suction openings
17, 17' Slot-shaped suction openings
18 Border area of the backing plate
19 Outer border of the backing plate
19' Rounded border of the backing plate
19" Barrel face of the backing plate
20 Drive shaft
22 Stop-Ring
24 Bore hole with internal thread
26 Rubber member
30 Suction hood
32 Brush rim
34 Suction socket
36 Bearing seat
37 Slip-Ring
38 Bellows
39 Barrel
40 Rotation bearing, ball bearing
50 Screw
52 Opening for a screw
60 Shaft locking ring
70 Shaft locking ring
100 Rotary grinding machine
110 Tool adaptor
120 Suction pipe
130 Grinding disc
130' Grinding disc with elevated border
132 perforation openings
200 Work piece
202 Upstand or concave fillet

The invention claimed is:

1. Backing plate unit (1) for a rotary grinding machine (100), comprising:

a) a backing plate (10) with a front face (12) for the fixation of a grinding disc (130) and a back face (14) oppositely located to the front face (12);

b) a drive shaft (20) of the backing plate (10) that can be attached to a tool adaptor (110) of the rotary grinding machine (100); and c) a suction hood (30) that is rotatably fixed to the drive shaft (20), the suction hood having a cylindrical barrel portion (39) having an outer diameter; wherein d) the backing plate (10) comprises suction openings (16, 17) that penetrate the backing plate (10), the suction openings (16, 17) being distributed so that there is a greater suction area proximal the border (18) than proximal the drive shaft (20);

e) the suction hood (30) is arranged for dust suctioning through the backing plate (10) to the back face (14) of the backing plate (10); and f) the border (19') of the backing plate (10) is rounded at the front face (12) and is broadened to become an upwardly extending cylindrical barrel surface (19"), having an outer diameter, the outer diameter of the cylindrical barrel surface (19") of the backing plate (10) being slightly larger than the outer diameter of the cylindrical barrel portion (39) of the suction hood (30);

g) whereby the cylindrical barrel portion (39) of the suction hood (30) engages from above the upwardly extending cylindrical barrel surface (19") of the backing plate (10) and seals the suction hood (30) to the backing plate (10).

2. Backing plate unit according to claim 1, wherein the backing plate unit (1) is designed as a refittable backing plate unit (1) that can be used universally in combination with any arbitrary rotary grinding machines (100).

3. Backing plate unit according to claim 1, wherein the drive shaft (20) is the only necessary connection of the backing plate unit (1) with a rotary grinding machine (100) and thus the backing plate unit (1) is designed as being independent from the machine.

4. Backing plate unit according claim 1, wherein the suction hood (30) is not part of a rotary grinding machine (100) and/or wherein the suction hood (30) is not directly connectable with the rotary grinding machine (100).

5. Backing plate unit according to claim 1, wherein the suction hood (30) is fixed by a rotation bearing (40), in particular a ball bearing (40), to the drive shaft (20).

6. Backing plate unit according to claim 1, wherein the suction hood (30) comprises a brush rim (32) or a slip ring (37) at its border that is directed to the backing plate (10).

7. Backing plate unit according to claim 1, wherein the suction hood (30) comprises a connection socket (34) for a pipe (120) of a dust suction device.

8. Backing plate unit according to claim 1, wherein the drive shaft (20) comprises a rubber member (26) and/or wherein the suction hood (30) comprises bellows (38) at its barrel.

9. Backing plate unit according to claim 1, wherein the suction openings (16, 17) are arranged at the border (18) of the backing plate (10) such that, as seen in radial direction from inside outwards, there are always suction openings (16) present at the entire circumference of the backing plate (10), so that dust that moves radially from inside outwards, due to centrifugal force, always meets a suction opening (16) at the border of the backing plate (10) and is sucked off to the back side through the backing plate (10).

10. Backing plate unit according to claim 9, wherein the suction openings (17) are designed as curved slots (17, 17') that are arranged such that, as seen from inside outwards, there are no gaps between the suction openings (16, 17) at the border of the backing plate (10).

11. Backing plate unit according to claim 1, wherein the barrel surface (19") is penetrated by suction openings (16').

* * * * *